US006394877B1

(12) United States Patent
Venditti

(10) Patent No.: US 6,394,877 B1
(45) Date of Patent: May 28, 2002

(54) BED LIFTING MECHANISM FOR MODEL TRUCK

(75) Inventor: Arthur Venditti, Peabody, MA (US)

(73) Assignee: Craft House Corporation, Toledo, OH (US)

( * ) Notice: Subject to any disclaimer, the term of this patent is extended or adjusted under 35 U.S.C. 154(b) by 58 days.

(21) Appl. No.: 09/685,182

(22) Filed: Oct. 11, 2000

(51) Int. Cl.[7] ..... A63H 17/26
(52) U.S. Cl. ..... 446/466; 446/437
(58) Field of Search ..... 446/428, 424, 446/432, 435, 436, 437, 466

(56) References Cited

U.S. PATENT DOCUMENTS 4,696,655 A * 9/1987 D'Andrade et al. ..... 446/330
5,618,219 A * 4/1997 Rodmaker
5,722,872 A * 3/1998 Simmons ..... 446/456
5,879,221 A * 3/1999 Barton
6,102,771 A * 8/2000 Goy
6,036,575 A * 9/2000 Rehkemper ..... 446/466
6,227,934 B1 * 5/2001 Dowd

FOREIGN PATENT DOCUMENTS

DE 20000001819 * 3/2000

* cited by examiner

*Primary Examiner*—Derris H. Banks
*Assistant Examiner*—Jamila Williams
(74) *Attorney, Agent, or Firm*—Donald R. Fraser

(57) ABSTRACT

A model truck having a mechanism driven by a reversible electric motor for selectively raising and lowering the front of the truck and the bed of the truck.

26 Claims, 3 Drawing Sheets

BED LIFTING MECHANISM FOR MODEL TRUCK

FIELD OF THE INVENTION

The present invention relates to model vehicles and more particularly to a model truck having a mechanism for selectively raising and lowering the front end of the vehicle in respect of the front wheels;; and the bed body may be selectively raised and lowered in respect of the rear wheels.

BACKGROUND OF THE INVENTION

The prior art is replete with-model cars and other similar vehicle replicas having wheels which may be driven, typically by a D.C. electric motor, to propel the vehicle forward or backward. Such motion of a vehicle imparts great interest in the attending youth.

An object of the invention is to produce a model truck which can be selectively caused to raise or lower the front end of the chassis; or the bed body.

Another object of the invention is to produce a model truck wherein the front end of the chassis of the model truck may be selectively raised or lowered in respect of the ground engaging front wheels, or the bed body of the model truck may be selectively raised or lowered in respect to the chassis, by the actuation of a reversible direct current electric motor.

SUMMARY OF THE INVENTION

The above, as well and other objects of the invention, may be readily achieved by a model truck assembly including:

- a chassis;
- a bed body having at least one elongate camming surface;
- a first set of ground engaging means;
- a second set of ground engaging means;
- at least one bed lifting arm having outer and inner ends, the outer end of the bed lifting arm adapted to contact the camming surface of the bed body;
- a first pivotal mounting intermediate the outer and inner ends of the bed lifting arm for pivotally mounting the bed lifting arm to the chassis;
- a reversible drive motor;
- a cam member engaging the bed lifting arm between the inner end thereof and the first pivotal mounting means; and
- a gear train for coupling the drive motor to the cam member.

BRIEF DESCRIPTION OF THE DRAWINGS

The above, as well. as other objects, features, and advantages of the present invention will be understood from the detailed description of the preferred embodiments of the present invention with reference to the accompanying drawings, in which.

DETAILED DESCRIPTION OF THE PREFERRED EMBODIMENT

Figure 1:
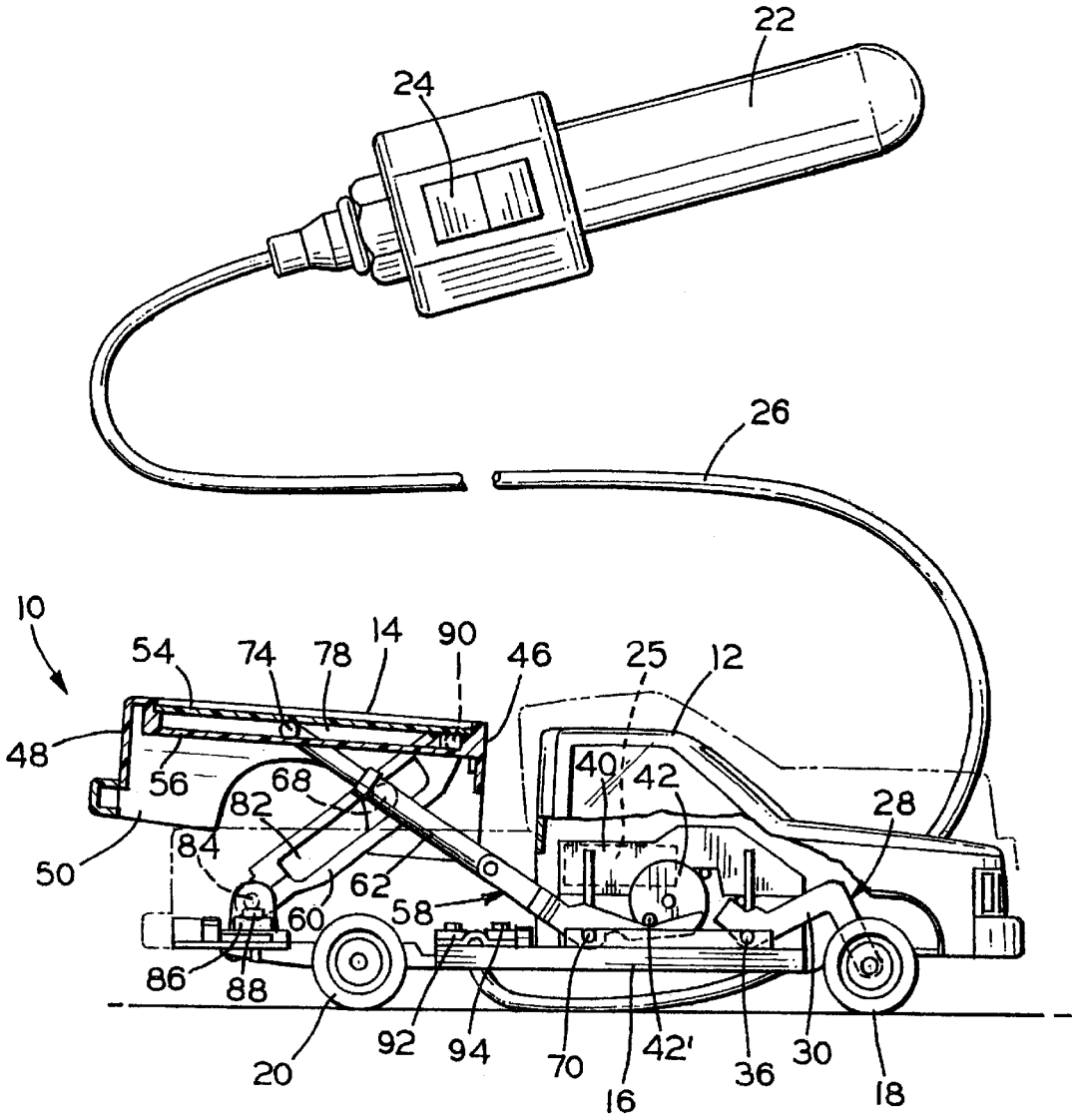
FIG. 1 is a side elevational view with portions cut away and in section to more clearly illustrate the structure of a model truck incorporating the features of the invention, and a phantom line illustrates the cab portion in the elevated position and the bed portion in the down or rest position.

Referring to the drawings, there is illustrated a preferred embodiment of the invention in the form of a model truck capable of selectively raising or lowering the cab body of the truck in respect of the associated front wheel assembly, or selectively raising or lowering the bed body of the truck in respect of the chassis.

Figure 2:
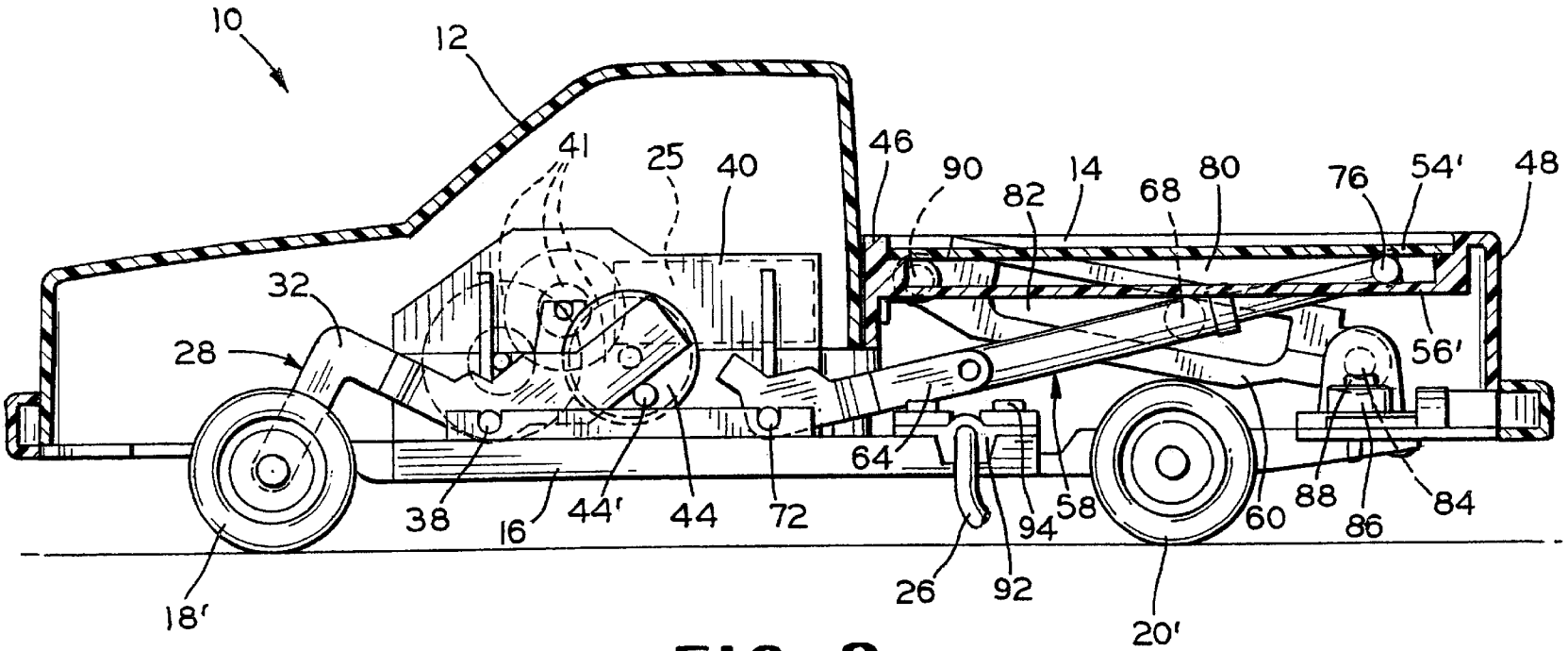
FIG. 2 is an enlarged side elevational view, partially in section, of the opposite side of the model truck illustrated in FIG. 1.
Figure 3:
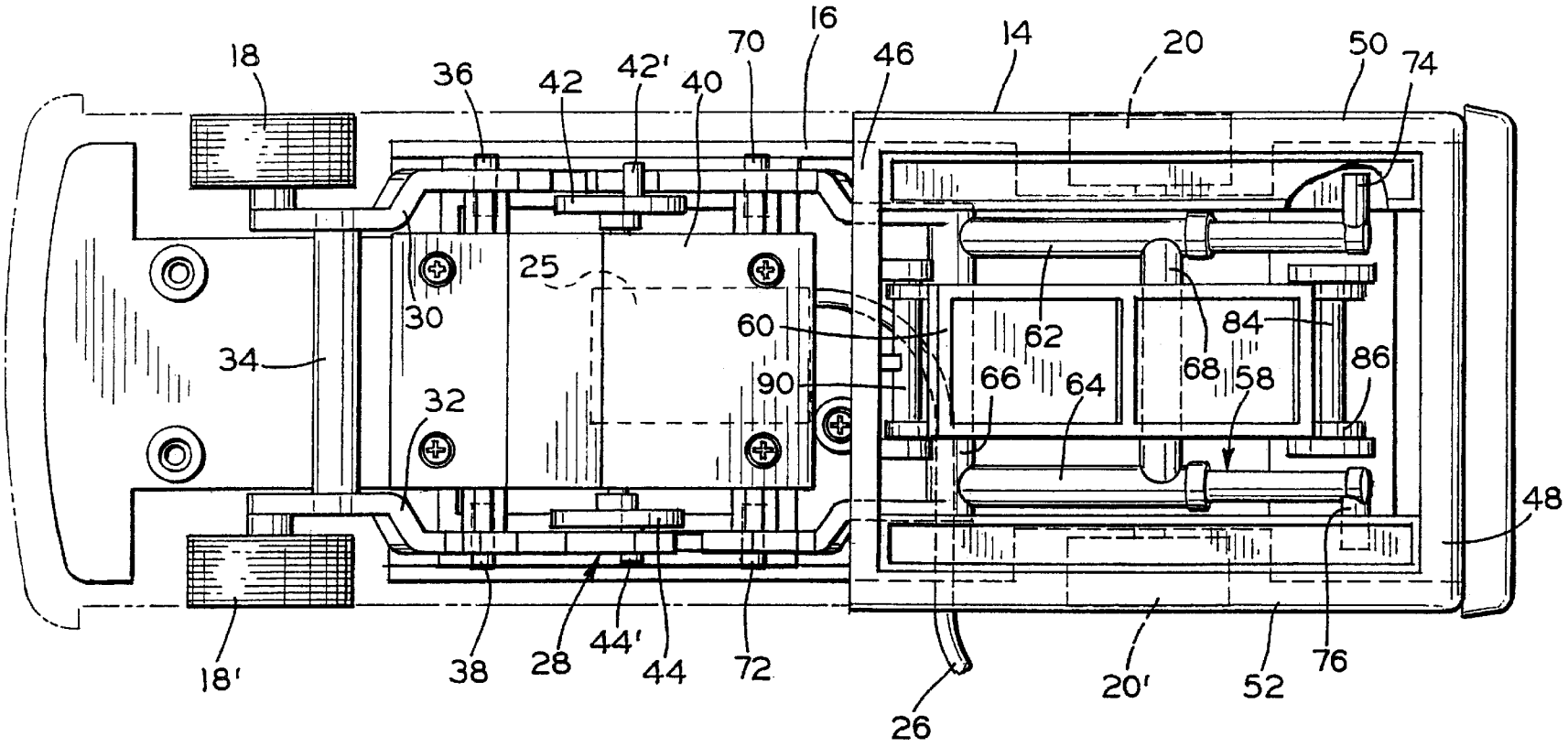
FIG. 3 is a top plan view of the model truck illustrated in FIG. 2, with the cab portion removed to more clearly show the internal components.

More specifically, there is shown in FIGS. 1, 2, and 3 a model truck, generally indicated by reference numeral 10, including a cab body 12; a bed body 14; a chassis 16; ground engaging front wheels 18, 18'; ground engaging rear wheels 20, 20'; and a power source 22, containing suitable batteries and having a rocker switch 24, coupled to a reversible electric motor 25 through a flexible electric cord 26.

The cab body 12, and bed body 14, typically replicate the sheet metal, glass, and bumpers of a conventional commercial vehicle. The chassis 16 is formed to replicate the vehicle frame, suspension components, and certain other components of the running gear. The cab body 12 is adapted to be coupled to the chassis 16 by fastening means such as threaded fasteners, for example. The cab body 12, bed body 14, and the chassis 16 may typically be formed of a plastic material which may be formed to genuinely represent the commercial vehicle. The plastic components may be glued together and/or assembled by suitable threaded fasteners.

The suspension of the truck 10 includes ground engaging front wheels 18, 18', and a front axle arm assembly 28. The front axle arm assembly 28, as clearly illustrated in FIG. 3, includes a pair of spaced apart generally parallel axle arms 30, 32, integrally joined together by a cross arm 34. Pivot pins 36, 38 are disposed intermediate the ends of the axle arms 30, 32, respectively. The forward outwardly extending terminal portions of the front axle arms 30, 32 are adapted to rotatingly receive the ground engaging front wheels 18, 18', respectively. The suspension of the truck 10 further includes ground engaging rear wheels 20, 20' adapted to be pivotally coupled to the chassis 16.

The reversible electric motor 25 is suitably mounted within an appropriately formed two-piece enclosure 40 suitably secured to the chassis 16. The motor 25 is provided with an output shaft having an output gear secured thereto. The output gear serves as the power input gear of a gear train 41 capable of selectively delivering power to oppositely disposed cam wheels 42, 44. The specific assembly of the electric motor 25 and gear train 41 is illustrated and described in U.S. Pat. No. 6,036,575 to Rehkemper et al.

It will be understood that once the motor 25 and all the associated gears of the gear train 25 are disposed in operative position on the base of the enclosure 40, the upper portion of the enclosure 40 is placed over the base and threaded fasteners are typically employed to maintain upper portion in place and simultaneously hold the gear shafts and pivot pins in operative position.

The bed body 14 includes a front wall 46, a rear wall 48, and two opposing side walls 50, 52. Inwardly opening, longitudinally extending, spaced apart, generally parallel members 54, 56 are suitably secured to the respective inner surfaces of the side walls 50, 52 adjacent the upper marginal edges of the side walls 50, 52. Although two longitudinally extending, spaced apart, generally parallel members 54, 56 are illustrated, it is understood that other configurations may be used, such as, for example, a single elongate camming surface, inwardly opening, longitudinally extending, and suitably secured to the respective inner surfaces of the side walls 50, 52 adjacent the upper marginal edges of the side walls 50, 52.

As illustrated in FIGS. 1, 2, and 3, the suspension of the bed body 14 is comprised of a bed lifting arm assembly 58 and a bed leveling arm 60. The bed lifting arm assembly 58 includes a pair of spaced apart generally parallel bed lifting arms 62, 64 integrally joined together by an inner cross arm 66, and an outer cross arm 68. In the illustrated embodiment, there are two bed lifting arms. However, it is understood that other configurations could be employed, such as, for example, one bed lifting arm. Pivot pins 70, 72 are disposed intermediate the ends of the bed lifting arms 62, 64, respectively, and are operative to pivotally connect the arms 62, 64 to the respective sides of the chassis 16. Additionally, camming pins 74, 76 are disposed at the distal ends of the bed lifting arms 62, 64 respectively and are adapted to be slidingly received within the respective slots 78, 80 of the bed body 14. Other camming means and configurations may be used. In the embodiment shown, camming pins 74, 76 are illustrated, but it is understood that other camming means, such as, for example, an elongate arm portion or a wheel rotatably coupled at the distal ends of the bed lifting arms could be utilized.

The bed leveling arm 60 is adapted to include a longitudinally extending slot 82 formed therein, and further adapted to slidingly receive the outer cross arm 68 of the bed lifting arm assembly 58. One end of the bed leveling arm 60 is adapted to be pivotally connected to the chassis 16 by a pivot pin 84. The pivot pin 84 is maintained in the chassis 16 by a bracket 86 secured to the chassis 16 by threaded fasteners 88. The other end of the bed lifting arm assembly 58 is adapted to be pivotally connected to the front wall 46 of the bed body 14 by a pivot pin 90, for example.

The flexible power cord 26 is caused to extend from the chassis 16 of the truck 10 and is maintained centrally of one side of the chassis 16 by a bracket 92 secured to the chassis 16 by threaded fasteners 94.

The cam wheel 42 for effecting movement of the bed lifting arm assembly 58, and the cam wheel 44 for effecting movement of the front axle arm assembly 28, will be explained in detail hereafter.

The cam wheel 42 is provided with an outwardly projecting cam 42', while the cam wheel 44 is provided with an outwardly projecting cam 44'. The cams 42', 44' are effective to cause movement of the bed lifting arm 62 and the front axle arm 32, respectively.

Motion is transmitted, as described in detail in U.S. Pat. No. 6,036,575 to Rehkemper et al., through the gear train 41 from the motor 25, causing the cam wheel 42 to be driven in an anti-clockwise direction. As the cam wheel 42 is caused to rotate, the cam pin 42' urges the bed lifting arm 62 to pivot about the pivot pin 70, as clearly illustrated in FIG. 1, causing the camming pins 74, 76 of the bed lifting arms 62, 64 to slide within the slots 78, 80 of the bed body 14, respectively, causing the bed body 14 to be moved upwardly. Further, the outer cross arm 68 of the bed lifting arm assembly 58 is caused to slide within the slot 82 of the bed leveling mechanism 60, causing the front wall 46 of the bed body 14 to be moved upwardly simultaneously with the rear wall 48 of the bed body 14.

When the drive motor 25 is caused to rotate in an opposite or clockwise direction by proper manipulation of the rocker switch 24, the cam wheel 44 is caused to rotate in a clockwise direction. Such rotation of the cam wheel 44 and the associated cam 44' urges the front axle arm 32 to pivot about a pivot pin 38, causing the front portion of the chassis 16 to be urged upwardly.

In each instance, it will be understood that as soon as the cam members 42', 44' are driven to their respective apogees, the cam members 42', 44' commence to travel downwardly allowing the weight of the cab body 12 of the truck 10 to return the truck 10 to apposition of rest at the ground level, and the weight of the bed body 14 to return the bed body 14 to a position of rest on the chassis 16.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A model truck assembly including:

a chassis;

a bed body having at least one elongate camming surface;

a first set of ground engaging means;

a second set of ground engaging means;

at least one bed lifting arm having outer and inner ends, the outer end of said bed lifting arm adapted to contact the camming surface of said bed body;

a first pivotal mounting intermediate the outer and inner ends of said bed lifting arm for pivotally mounting said bed lifting arm to said chassis;

a reversible drive motor;

a cam member engaging said bed lifting arm between the inner end thereof and said first pivotal mounting means; and a gear train for coupling said drive motor to said cam member.

2. The model truck according to claim 1, wherein said first set of ground engaging means includes ground engaging wheels.

3. The model truck according to claim 1, wherein said second set of ground engaging means includes ground engaging wheels.

4. The model truck according to claim 1, wherein said bed body includes at least one side wall, said side wall having an inner surface and an outer surface.

5. The model truck according to claim 4, wherein the elongate camming surface is disposed on the inner surface of said side wall.

6. The model truck according to claim 4, wherein said bed body includes at least one set of substanitially parallel elongate camming surfaces disposed on the inner surface of at least one side wall thereof.

7. The model truck according to claim 6, wherein the set of substantially parallel elongate camming surfaces form a slot there between, the slot adapted to receive the outer end of said bed lifting arm.

8. The model truck according to claim 1, wherein the outer end of said bed lifting arm includes a wheel rotatably coupled to the outer end of said bed lifting arm, the wheel adapted to contact the camming surface of said bed body.

9. The model truck according to claim 1, wherein said bed lifting arm includes a camming surface between the outer and inner ends of thereof.

10. The model truck according to claim 9, wherein said bed body includes a leveling arm having outer and inner ends, said leveling arm adapted to contact the camming surface of said bed lifting arm.

11. The model truck according to claim 10, wherein said leveling arm includes a second pivotal mounting for pivotally mounting the inner end of said leveling arm to said bed body.

12. The model truck according to claim 11, wherein said leveling arm includes a third pivotal mounting for pivotally mounting the outer end of said leveling arm to said chassis.

13. The model truck according to claim 12, wherein said leveling arm is adapted to replicate the sheet metal of the bed of a conventional commercial truck.

14. A model truck assembly including:

a chassis having a front end and a rear end;

a bed body disposed on said chassis;

a first set of arms pivotally mounted to said chassis;

a second set of arms pivotally mounted to said chassis;

a reversible drive motor having switch means for selectively driving said motor in a first direction or a second direction;

a first cam member coupled to said chassis and engaging said first set of arms;

a second cam member coupled to said chassis and engaging said second set of arms; and a gear train for coupling said drive motor to said first cam member and said second cam member, whereby energization of said motor in a first direction drives said first cam member and energization of said motor in a second direction drives said second cam member to selectively cause upward movement of the front end of said chassis, and said bed body, respectively.

15. The model truck according to claim 14, wherein said second set of arms includes outer and inner ends.

16. The model truck according to claim 15, wherein said second set of arms includes a camming surface between the outer and inner ends of thereof.

17. The model truck according to claim 16, wherein said bed body includes at least one third arm having outer and inner ends, said third arm adapted to contact the camming surface of said second set of arms.

18. The model truck according to claim 17 including a first pivotal mounting for pivotally mounting the inner end of said third arm to said bed body.

19. The model truck according to claim 18, including a second pivotal mounting for pivotally mounting the outer end of said third arm to said chassis.

20. The model truck according to claim 14, wherein said bed body includes at least one side wall, said side wall having an inner surface and an outer surface.

21. The model truck according to claim 20, wherein said bed body includes at least one elongate camming surface disposed on the inner surface of said side wall.

22. The model truck according to claim 20, wherein said bed body includes at least one set of substantially parallel elongate camming surfaces disposed on the inner surface of said side wall.

23. A model truck assembly including:

a chassis;

a bed body disposed on said chassis;

at least one first arm having an outer end and an inner end;

a ground engaging means disposed at the outer end of said first arm;

a first pivotal mounting intermediate the outer end and the inner end of said first arm for pivotally mounting said first arm to said chassis;

at least one second arm having an outer end and an inner end, a cammimg surface between the outer and inner ends, the outer end of said second arm adapted to receive said bed body;

a second pivotal mounting intermediate the outer end and the inner end of said second arm for pivotally mounting said second arm to said chassis;

at least one third arm having an outer end and an inner end, said third arm adapted to contact the camming surface of said second arm;

a third pivotal mounting for pivotally mounting the inner end of said third arm to said bed body;

a fourth pivotal mounting for pivotally mounting the outer end of said third arm to said chassis;

a reversible drive motor;

a first cam member engaging said first arm between the inner end thereof and said first pivotal mounting;

a second cam member engaging said second arm between the inner end thereof and said second pivotal mounting; and a gear train for coupling said drive motor to said first cam member and said second cam member.

24. The model truck according to claim 23, wherein said ground engaging means includes ground engaging wheels.

25. The model truck according to claim 23, wherein said chassis includes a front portion and a rear portion.

26. The model truck according to claim 25, wherein said rear portion of said chassis includes a set of ground engaging wheels rotatably coupled thereto.

* * * * *